US005299411A

United States Patent [19]

Yamamoto et al.

[11] Patent Number: 5,299,411

[45] Date of Patent: Apr. 5, 1994

[54] WRAPPING SHEET WINDING APPARATUS

[75] Inventors: Kiyohumi Yamamoto; Hiroshi Maeda; Susumu Suzuki, all of Shizuoka, Japan

[73] Assignee: Fuji Photo Film Co., Ltd., Kanagawa, Japan

[21] Appl. No.: 982,035

[22] Filed: Nov. 24, 1992

Related U.S. Application Data

[63] Continuation of Ser. No. 750,170, Aug. 26, 1991, abandoned.

[30] Foreign Application Priority Data

Aug. 27, 1990 [JP] Japan ..... 2-224788
Feb. 28, 1991 [JP] Japan ..... 3-34180

[51] Int. Cl.[5] ..... B65B 11/04
[52] U.S. Cl. ..... 53/465; 53/211
[58] Field of Search ..... 53/211, 212, 214, 216, 53/217, 465, 587, 389.1, 389.2

[56] References Cited

U.S. PATENT DOCUMENTS 1,632,344 6/1927 Modlin ..... 53/212 X
2,631,417 3/1953 Harrison ..... 53/211 X
2,893,190 7/1959 Lancaster .
3,075,325 1/1963 Liedtke .
3,340,882 9/1967 Holmes et al. ..... 53/212 X
3,798,873 3/1974 Frahm ..... 53/212
3,875,723 4/1975 Sundin .
4,173,108 11/1979 Eglinton et al. ..... 53/211 X
4,305,408 12/1981 Hartman ..... 53/211 X
4,700,529 10/1987 Bargholtz et al. ..... 53/216 X

FOREIGN PATENT DOCUMENTS 719595 6/1942 Fed. Rep. of Germany ..... 53/216
49-27390 3/1974 Japan .

*Primary Examiner*—John Sipos
*Assistant Examiner*—Linda B. Johnson
*Attorney, Agent, or Firm*—Sughrue, Mion, Zinn, Macpeak & Seas

[57] ABSTRACT

A wrapping sheet is disposed on a roll so that marginal portions of the wrapping sheet extend beyond the respective side faces of the roll. A wrapping sheet winding apparatus for winding the wrapping sheet around the roll has a pair of chucks which are drivingly engaged with a core of the roll and rotate the roll to wind therearound the wrapping sheet. Each of the chucks is provided with suction holes formed on the outer peripheral surface thereof.

7 Claims, 6 Drawing Sheets

WRAPPING SHEET WINDING APPARATUS

This is a continuation of application Ser. No. 07/750,170 filed Aug. 26, 1991 now abandoned.

BACKGROUND OF THE INVENTION

1. Field of the Invention

This invention relates to an apparatus for winding a wrapping sheet around the outer peripheral surface of a roll.

2. Description of the Prior Art

In the majority of the conventional wrapping sheet winding apparatus, a wrapping sheet is wound around the outer peripheral surface of a roll by causing a pair of chucks to abut against respective end faces of the roll and rotating them as disclosed, for instance, in Japanese Unexamined Patent Publication No. 49(1974)-27390. Further, generally, the wrapping sheet is positioned relative to the roll so that marginal portion of the wrapping sheet extends beyond the side of the roll and then wound around the article in the manner described above in order to wrap also the end faces of the article.

However, in such conventional apparatuses, the wrapping sheet is apt to be displaced relative to the roll during the winding operation, and irregular folds or creases are frequently produced in the marginal portions of the wrapping sheet.

Especially when the diameter or the width of the roll change, production of such irregular folds or creases becomes more remarkable due to change in the winding condition.

SUMMARY OF THE INVENTION

In view of the foregoing observations and description, the primary object of the present invention is to provide a wrapping sheet winding apparatus in which the wrapping sheet can be prevented from being displaced relative to the roll during the winding operation and production of irregular folds and creases in the marginal portions of the wrapping sheet can be suppressed.

Another object of the present invention is to provide a wrapping sheet winding apparatus in which the wrapping sheet can be prevented from being displaced relative to the roll during the winding operation and production of irregular folds and creases in the marginal portions of the wrapping sheet can be suppressed even if the lengths and/or diameters of the articles fluctuate.

In accordance with the present invention, the chucks are provided with suction holes on their outer peripheral surfaces.

The marginal portions of the wrapping sheet extending beyond the sides of the roll are pulled against the outer peripheral surfaces of the chucks under suction force applied to the suction holes during winding operation, and accordingly the wrapping sheet can be prevented from being displaced relative to the roll during the winding operation and production of irregular folds and creases in the marginal portions of the wrapping sheet can be suppressed.

In a preferred embodiment of the present invention, each of the chucks comprises a chuck head portion which is engaged with the end face of the roll to drive it and a suction head portion which is provided with suction holes on its outer peripheral surface and is movable toward and away from the chuck head portion along the rotational axis of the chuck.

If slack is produced in the wrapping sheet due to fluctuation in the lengths and/or diameters of the articles when the marginal portions of the wrapping sheet extending beyond the sides of the roll are pulled against the outer peripheral surfaces of the chucks under suction force applied to the suction holes, the slack can be removed by pulling outward the wrapping sheet by moving outward the suction head portions of the chucks away from the chuck head portions.

Thus in accordance with the preferred embodiment, the wrapping sheet can be prevented from being displaced relative to the roll during the winding operation and production of irregular folds and creases in the marginal portions of the wrapping sheet can be suppressed even if the lengths and/or diameters of the rolls fluctuate. Such arrangement is especially effective for wrapping sheets which are relatively flexible.

DESCRIPTION OF THE PREFERRED EMBODIMENTS

Figure 1:
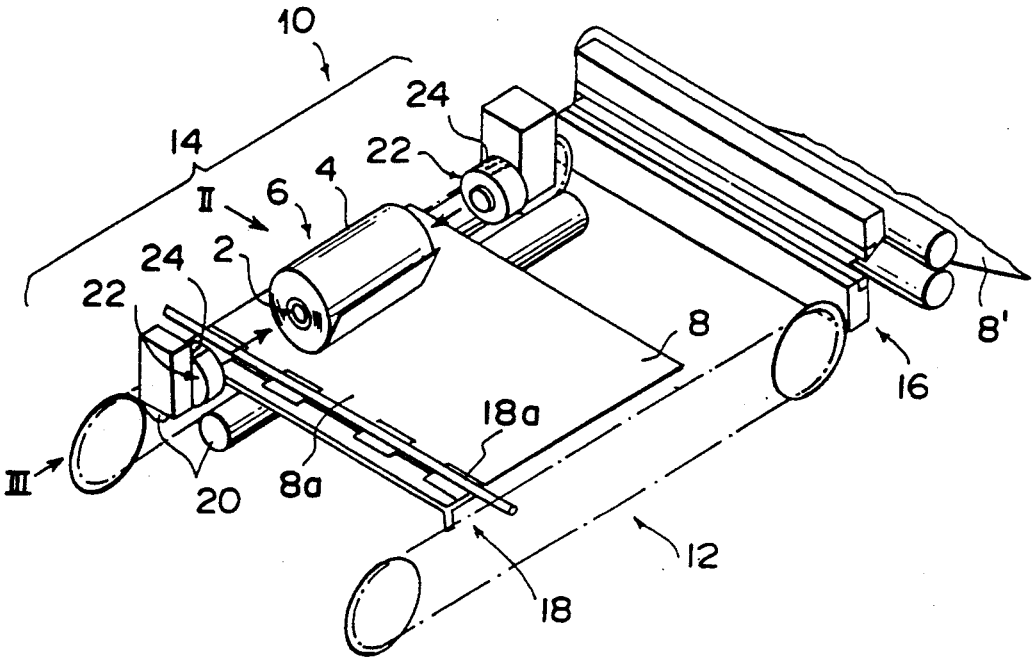
FIG. 1 is a schematic perspective view showing a wrapping sheet winding apparatus in accordance with a first embodiment of the present invention.

In FIG. 1,.a wrapping sheet winding apparatus 10 in accordance with a first embodiment of the present invention winds a wrapping sheet 8 around a web roll 6 which comprises a tubular core 2 and a web 4 of a predetermined length wound around the core 2. The apparatus 10 comprises a wrapping sheet supply system 12 for supplying a wrapping sheet 8 of a predetermined size, a web roll supply system (not shown) for supplying the web roll 6 and a sheet winding system 14 for winding the wrapping sheet 8 around the web roll 6.

The wrapping sheet supply system 12 includes a cutter section 16 which cuts the wrapping sheet 8' in continuous length into a wrapping sheet 8 of a predetermined length longer than the width of the web 4 by a predetermined length, and a conveyor section 18 which clamps the wrapping sheet 8 and conveys it to the position shown in FIG. 1 where one leading edge portion 8*a* of the wrapping sheet 8 rests on a pair of support rollers 20 of the sheet winding system 14. Reference numeral 18*a* denotes a clamp member which clamps the leading end of the wrapping sheet 8.

The web roll supply system places the web roll 6 on the leading edge portion 8*a* of the wrapping sheet 8 resting on the support rollers 20 so that the wrapping sheet 8 extends beyond each side face of the web roll 6.

The sheet winding system 14 has a pair of cylindrical chucks 22 which are adapted to be engaged with the core 2 of the web roll 6 to rotate the web roll 6. Each chuck 22 has an outer diameter smaller than the outer diameter of the web roll 6 (e.g., ½ to 11/12 of the outer diameter of the web roll 6), and a plurality of suction holes 24 are formed on the outer peripheral surface of the chuck 22.

Figure 2A:
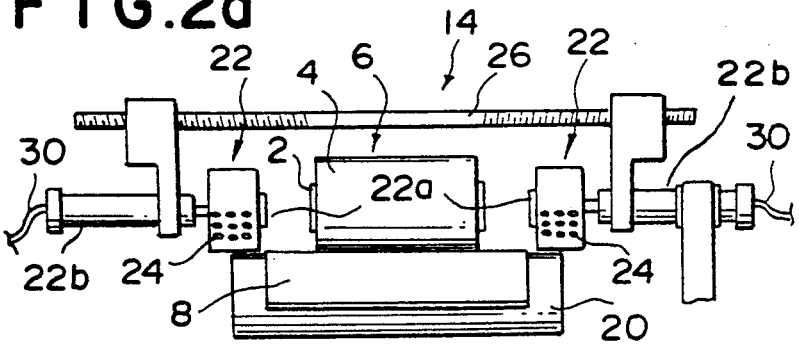
FIGS. 2*a* to 2*c* are views as viewed in the direction of arrow II in FIG. 1 for showing in detail the sheet winding system and for illustrating the operation of the same.
Figure 2B:
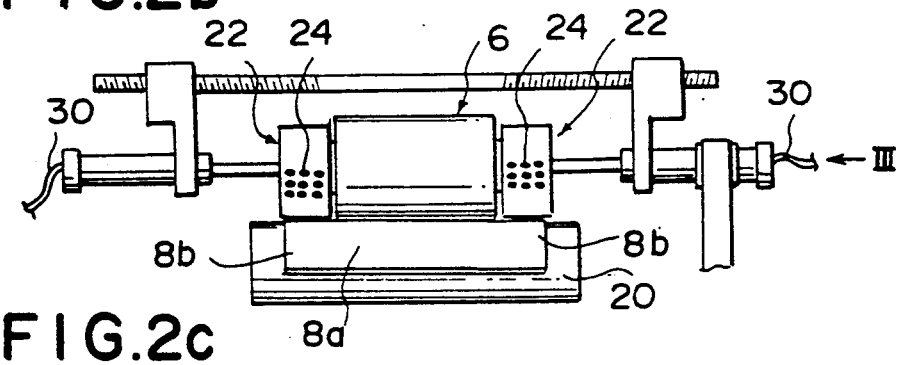
Figure 2C:
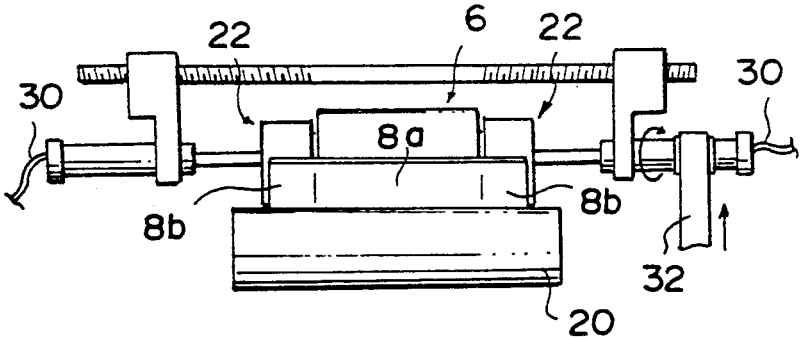

As shown in FIGS. 2a to 2c, the chucks 22 are supported by a threaded rod 26 spaced from each other with their rotational axes in alignment with each other. The web roll 6 is placed on the wrapping sheet 8 in a position where the central axis of the web roll 6 is in alignment with the rotational axes of the chucks 22 as shown in FIG. 2a. Each chuck 22 has a tapered head portion 22a and is supported by way of an air cylinder 22b to be driven toward and away from the web roll 6 by the cylinder 22b. After the web roll 6 is placed on the wrapping sheet 8 in the manner described above, the chucks 22 are driven toward the web roll 6 and the tapered head portions 22a thereof are brought into engagement with the ends of the core 2 as shown in FIG. 2b. At this time the outer peripheral surfaces of the chucks 22 are opposed to the wrapping sheet 8 at a small distance therefrom.

Figure 3:
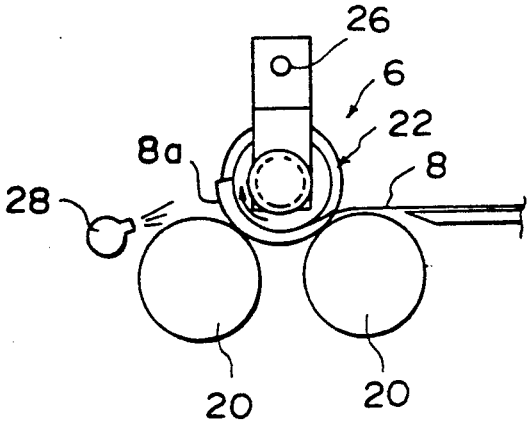
FIG. 3 is a fragmentary front view as viewed in the direction of arrow III in FIG. 1.

The sheet winding system 14 further includes a blower 28 disposed near the support rollers 20 (FIG. 3), and the blower 28 blows air to the leading edge portion 8a of the wrapping sheet 8 from below so that the leading portion 8a is pressed against the outer peripheral surface of the web roll 6 as shown in FIG. 3. At the same time, suction force is fed to the suction holes 24 of the chucks 22 through suction pipes 30, whereby marginal portions 8b which extend beyond the sides of the web roll 6 are pulled against the outer peripheral surfaces of the chucks 22 under suction force. At this time, since the chucks 22 are smaller than the web roll 6 in diameter, the marginal portions 8b are pulled outward by the suction force, tightly fixing the leading portion 8a to the wrapping sheet itself.

Then the chucks 22 are driven by belts 32 as shown in FIG. 2c, whereby the web roll 6 is rotated and the wrapping sheet 8 is wound around the web roll 6. Since the marginal portions 8b are held on the outer peripheral surface of the chucks 22 under the suction force, the wrapping sheet 8 cannot be displaced relative to the web roll 6 during the winding operation. Further, since the wrapping sheet 8 is kept under tension during the winding operation due to the suction force applied to the marginal portions 8b and leading portion 8a as described above, irregular folds or creases cannot be produced in the leading portion 8a or the marginal portions 8b.

In the case when the wrapping sheet 8 is hard, it is preferred that the chucks 22 are substantially equal to the web roll 6 in diameter in order to smoothly wind the wrapping sheet 8 around the web roll 6.

A second embodiment of the present invention will be described with reference to FIGS. 4 to 6, hereinbelow.

The wrapping sheet winding apparatus 11 in accordance with the second embodiment of the present invention comprises a wrapping sheet supply system 13 for supplying the wrapping sheet 8, a web roll supply system 17 for supplying the web roll 6 and a sheet winding system 15 for winding the wrapping sheet 8 around the web roll 6.

Figure 4A:
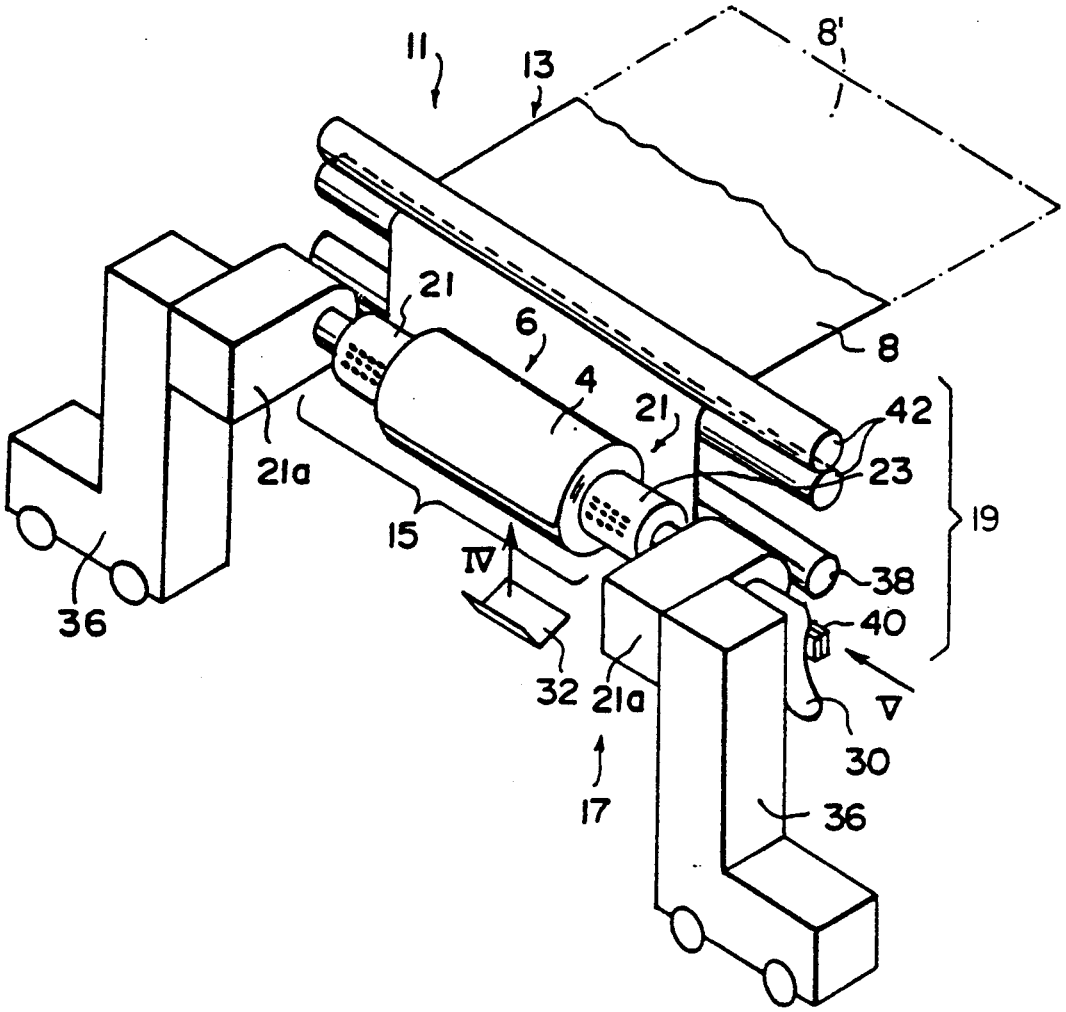
FIG. 4*a* is a schematic perspective view showing a wrapping sheet winding apparatus in accordance with a second embodiment of the present invention.
Figure 4B:
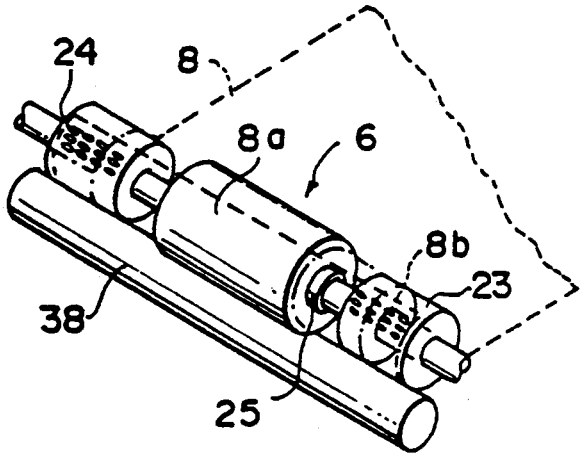
FIG. 4*b* is a fragmentary view as viewed in the direction of arrow IV in FIG. 4*a*, FIGS. 5*a* to 5*e* are views similar to FIG. 4*b* but showing different stages of the operation of the sheet winding system.

The wrapping sheet supply system 13 includes a cutter section (not shown) which cuts the wrapping sheet 8' in continuous length into a wrapping sheet 8 of a predetermined length longer than the width of the web 4 by a predetermined length, and a conveyor section 19 which conveys it to the position shown in FIG. 4a.

Figure 6A:
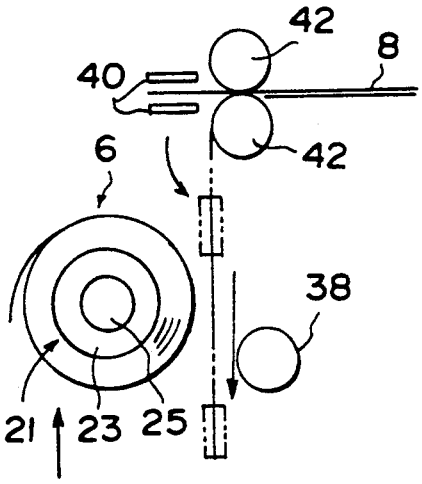
FIGS. 6*a* to 6*c* are side views for illustrating the operation of the wrapping sheet supply system.

That is, the conveyor section 19 comprises a pair of conveyor rollers 42 and a sheet drawing mechanism 40 which clamps the leading end of the wrapping sheet 8 conveyed by the conveyor rollers 42 and draws the wrapping sheet 8 to a winding position as shown in FIG. 6a.

The sheet winding system 15 comprises a pair of cylindrical chucks 21 and a winding roller 38 which is longer than the web roll 6 and is movable toward and away from the web roll 6 held by the chucks 21 as will be described later. Each chuck 21 comprises a chuck head portion 25 which is adapted to be engaged with the core 2 of the web roll 6 and a suction head portion 23 provided with suction holes 24 on the outer peripheral surface thereof. Each chuck 21 is supported on an up-and-down frame member 36 by way of a cylinder member so that the central axes of the chucks are in alignment with each other. The chucks 21 are driven by the cylinder member 21a toward and away from the each other. The suction head portion 23 of each chuck 21 is smaller in diameter than the web roll 6. Further the suction head portion 23 of each chuck 21 is movable toward and away from the chuck head portion 25 along the central axis of the chuck 21.

The web roll supply system 17 comprises a bucket conveyor 32 which feeds the web rolls 6 one by one.

When a web roll 6 is fed by the bucket conveyor 32, the up-and-down frame member 36 moves downward to a position where the chucks 21 are aligned with the web roll 6, and the chucks 21 are driven toward the web roll 6 and brought into engagement with the core 2 of the web roll 6, thereby holding the web roll 6 therebetween. Thereafter, the up-and-down frame member 36 moves upward to bring the web roll 6 to the position shown in FIG. 4a and FIG. 6a, where the web roll 6 is positioned close to the wrapping sheet 8 hanging from the conveyor rollers 42.

Figure 5A:
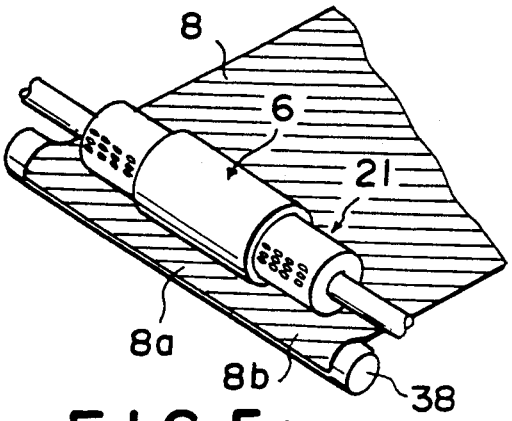
Figure 6B:
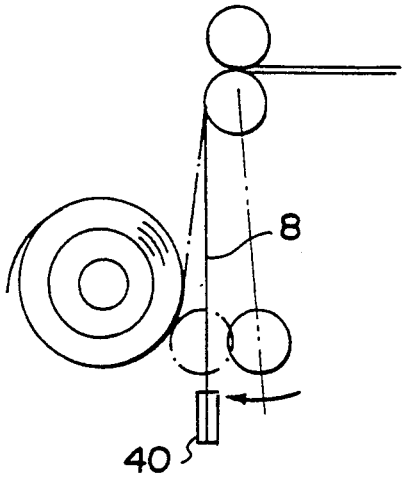

Then the winding roller 38 moves toward the web roll 6 and presses the wrapping sheet 8 against the web roll 6 as shown in FIG. 6b. FIG. 5a shows the chucks 21, web roll 6 and the winding roller 38 in this state.

Figure 5B:
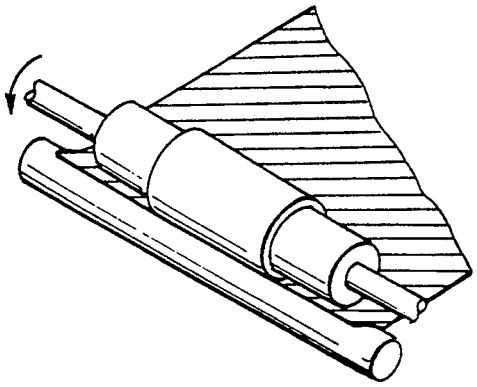

In this state, the chucks 21 are rotated in the direction reverse to the winding direction to bring the leading edge of the wrapping sheet 8 on the contact line of the roller 38 and the web roll 6 as shown in FIG. 5b. At this time, the suction head portions 23 of the chucks 21 are opposed to marginal portions 8b of the leading edge portion 8a of the wrapping sheet 8 at a small distance therefrom.

Figure 5C:
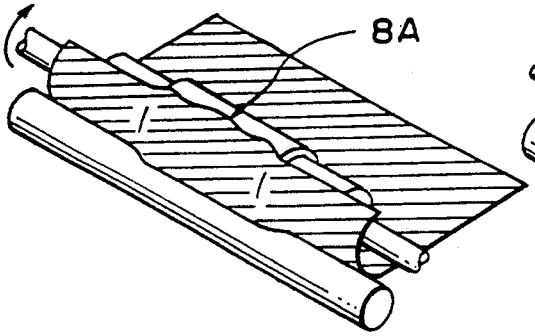
Figure 5D:
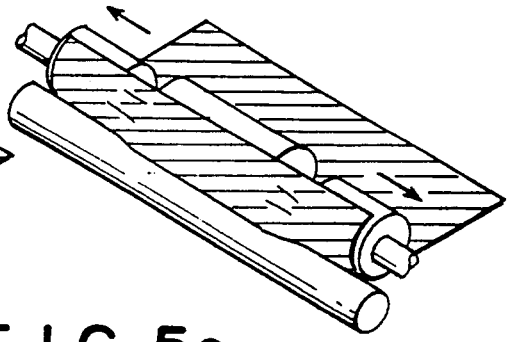
Figure 5E:
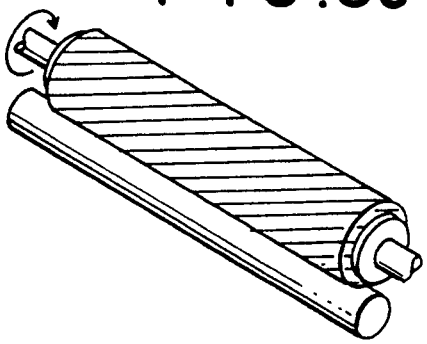
Figure 6C:
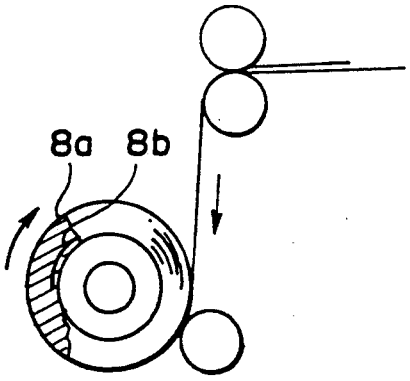

Then suction force is applied to the suction head portion 23 and the marginal portions 8b are pulled against the outer peripheral surfaces of the chucks 22 under suction force. Thereafter the chucks 21 are rotated to wind the wrapping sheet 8 around the web roll 6 by ½ to 11/12 of the circumference as shown in FIG. 6c and 5c. Depending on the length and/or the diameter of the web roll 6, slack (indicated at 8A in FIG. 5c) can be produced in the wrapping sheet 8 between the ends of the web roll 6 as shown in FIG. 5c. When such slack 8A is produced, the suction head portions 23 are moved outward relative to the chuck head portion 25 as shown in FIG. 5d, whereby the wrapping sheet 8 are pulled in opposite directions and the slack 8A is removed. Thereafter the chucks 21 are further rotated to wind the wrapping sheet 8 completely around the web roll 6 as shown in FIG. 5e.

As can be understood from the description above, by sliding the suction head portions 23 by an appropriate distance, production of slack in the wrapping sheet 8 can be prevented even if the length and/or the diameter of the web roll 6 to be wrapped changes, thereby preventing production of irregular folds or creases.

When the outer diameter of each chuck 21 is substantially equal to the outer diameter of the web roll 6 having a minimum diameter, all the web rolls 6 including wide range of outer diameters can be wrapped with the wrapping sheet 8 with a better appearance by sliding the suction head portions 23 by an appropriate distance.

Further, the wrapping sheet winding apparatus in accordance with the present invention is advantageous in that the wrapping sheet 8 is firmly held on the chucks and less air is trapped in the wrapping sheet and accordingly the wrapping sheet can be tightly wound around the web roll.

What is claimed is:

1. A method for wrapping a continuous sheet of wrapping material around a cylinder roll with a core, said method comprising the steps of:

(a) feeding a continuous sheet of wrapping material to a wrapping station, (b) cutting said continuous sheet of wrapping material into a wrapping sheet of a predetermined length longer than a width of a cylinder roll with a core around which said wrapping sheet is to be wrapped, (c) conveying said wrapping sheet to a winding position, (d) placing a leading edge portion of said wrapping sheet at a predetermined position on a pair of support rollers, (e) placing said cylinder roll on said leading edge portion of said wrapping sheet placed on said support rollers, (f) providing a pair of chuck members each having an outer diameter smaller than an outer diameter of said cylinder roll and a first portion having a plurality of suction holes on an outer peripheral surface thereof, said first portions being movable away from each other, (g) moving said pair of chuck members to drivingly and rotatably engage said core of said cylinder roll, (h) blowing air against said leading edge portion of said wrapping sheet while simultaneously applying a vacuum to said suction holes on said chuck members and moving said first portions of said chuck members having said suction holes away from each other so that marginal portions of said wrapping sheet which extend beyond respective ends of said cylinder roll are pulled taut against said outer peripheral surface of said first portion of said chuck members, and (i) rotating said chuck members so that said cylinder roll is rotated and said wrapping sheet is wound around said cylinder roll.

2. A method for wrapping a sheet of wrapping material around a cylinder roll with a core, said method comprising the steps of:

(a) feeding a sheet of wrapping material through a pair of conveyor rollers, (b) clamping a leading end portion of said sheet of wrapping material, (c) providing a pair of chuck members each having an outer diameter smaller than an outer diameter of a cylinder roll with a core, and including a first portion having a plurality of suction holes on an outer peripheral surface thereof, said first portion being movable away from each other, (d) moving said pair of chuck members to drivingly and rotatably engage said core of said cylinder roll, (e) moving said cylinder roll held by said chuck members to a position where said leading end portion of said sheet of wrapping material is positioned between a winding roller and said cylinder roll, (f) placing said leading end of said sheet of wrapping material at a wrapping position by moving said winding roller toward said cylinder roll such that said leading end portion of said sheet of wrapping material is pressed against said cylinder roll, and marginal portions of said sheet of wrapping material extend beyond respective ends of said cylinder roll and press against respective ones of said chuck members, (g) rotating said chuck members in a direction opposite to a winding direction of said cylinder roll to align said leading end portion of said sheet of wrapping material with a contact line of said winding roller, (h) applying a vacuum to said suction holes on said chuck members and moving said first portions of said chuck members having said suction holes away from each other so that said marginal portions of said sheet of wrapping material are pulled taut against said outer peripheral surfaces of said first portion of said chuck members, and (i) rotating said chuck members such that the cylinder roll is rotated and the sheet of wrapping paper is wound around the cylinder roll.

3. A method for wrapping a sheet of wrapping paper around a cylinder roll with a core as defined in claim 2, further comprising the steps of:

(c) (a) providing each chuck member of said pair of chuck members with a chuck head portion which is engagable with said core of said cylinder roll, and with said first portion, said first portion including a suction head portion with said suction holes on an outer peripheral surface thereof, and (c) (b) providing each of said suction head portions to be movable toward and away from said chuck head portion along a rotational axis of said chuck member.

4. An apparatus for wrapping a continuous sheet of wrapping material around a cylinder roll with a core, said apparatus comprising:

a wrapping station;

wrapping sheet supply means for supplying a wrapping sheet of a predetermined size to said wrapping station;

cylinder roll supply means for supplying and placing said cylinder roll on said wrapping sheet;

sheet winding means for winding said wrapping sheet around said cylinder roll; and means for applying a suction to said sheet winding means, wherein said sheet winding means includes a pair of chuck members for drivingly and rotatably engaging said cylinder roll, said chuck members each having an outer diameter smaller than an outer diameter of said cylinder roll and a first portion having a plurality of suction holes, coupled to said suction applying means, on an outer peripheral surface thereof and means for moving said first portions away from each other to pull said wrapping sheet taut so as to prevent creases from forming in the wrapping sheet wound around said cylinder roll by said sheet winding means.

5. An apparatus for wrapping a continuous sheet of wrapping material around a cylinder roll with a core as recited in claim 4, further comprising:

means for blowing air against a leading edge of said wrapping sheet when a suction is applied by said suction applying means to said suction holes on said first portion of said chuck members so that marginal portions of said wrapping sheet which extend beyond respective ends of said cylinder roll are pulled against said outer peripheral surface of said first portion of said chuck members.

6. An apparatus for wrapping a continuous sheet of wrapping material around a cylinder roll with a core, said apparatus comprising:

a pair of chuck members, said chuck members each having an outer diameter smaller than an outer diameter of said cylinder roll and a first portion having a plurality of suction holes on an outer peripheral surface thereof, said first portion being movable;

frame means for moving said pair of chuck members to drivingly and rotatably engage said cylinder roll;

a winding roller movable toward and away from said frame means;

wrapping sheet supply means for supplying a wrapping sheet of a predetermined size between said frame means and said winding roller;

means for moving said winding roller toward said frame means and for pressing said wrapping sheet against said cylinder roll;

means for applying a vacuum to said suction holes on said first portion of said chuck members for causing marginal portions of said wrapping sheet which extend beyond restrictive ends of said cylinder roll to be pulled against said outer peripheral surface of said first portion of said chuck members; and means for moving said first portions away from each other.

7. An apparatus for wrapping a continuous sheet of wrapping material around a cylinder roll with a core as recited in claim 6, wherein each chuck member of said pair of chuck members comprises a chuck head portion which is engaged with said core of said cylinder roll and said first portion, said first portion comprising a suction head portion provided with said suction holes on an outer peripheral surface thereof, each of said suction head portions being movable toward and away from said chuck head portion along a rotational axis of said chuck.

* * * * *